US007179349B2

(12) United States Patent
Koivukunnas

(10) Patent No.: US 7,179,349 B2
(45) Date of Patent: Feb. 20, 2007

(54) METHOD AND DEVICE FOR PASSING A WEB IN CONNECTION WITH A FINISHING DEVICE OF A PAPER OR BOARD MACHINE

(75) Inventor: Pekka Koivukunnas, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 467 days.

(21) Appl. No.: 10/432,202

(22) PCT Filed: Nov. 21, 2001

(86) PCT No.: PCT/FI01/01008

§ 371 (c)(1),
(2), (4) Date: Sep. 25, 2003

(87) PCT Pub. No.: WO02/42553

PCT Pub. Date: May 30, 2002

(65) Prior Publication Data

US 2004/0050516 A1 Mar. 18, 2004

(30) Foreign Application Priority Data

Nov. 21, 2000 (FI) ..... 20002550

(51) Int. Cl.
*D21G 1/00* (2006.01)
*D21G 9/00* (2006.01)
*B30B 15/30* (2006.01)

(52) U.S. Cl. ..... 162/193; 162/205; 162/206; 162/361; 100/160; 100/173; 100/207

(58) Field of Classification Search ..... 162/193, 162/204–207, 361; 100/38, 155 R, 161, 100/162 R, 167, 173, 176, 193, 207; 226/1, 226/91, 92, 170–172, 189
See application file for complete search history.

(56) References Cited

U.S. PATENT DOCUMENTS

| | | | | |
|---|---|---|---|---|
| 327,031 | A * | 9/1885 | Smith | 100/166 |
| 2,755,711 | A * | 7/1956 | Moore | 100/166 |
| 4,904,344 | A | 2/1990 | Peiffer | |
| 5,456,802 | A | 10/1995 | Worcester | |
| 5,469,784 | A | 11/1995 | Hess | |
| 5,483,873 | A | 1/1996 | Koivukunnas et al. | |
| 5,524,532 | A * | 6/1996 | Koivukunnas et al. | 100/38 |
| 5,593,545 | A * | 1/1997 | Rugowski et al. | 162/207 |
| 5,738,760 | A | 4/1998 | Svanqvist et al. | |
| 6,003,750 | A | 12/1999 | Hermsen | |
| 6,402,892 | B1 | 6/2002 | Kilpiä et al. | |
| 6,616,809 | B2 * | 9/2003 | Conrad et al. | 162/283 |
| 6,716,308 | B2 * | 4/2004 | Baggot et al. | 162/109 |

FOREIGN PATENT DOCUMENTS

FI 95061 8/1995

(Continued)

OTHER PUBLICATIONS

Search Report issued in Finnish Priority Application No. 20002550.

(Continued)

*Primary Examiner*—Eric Hug
(74) *Attorney, Agent, or Firm*—Stiennon & Steinnon

(57) ABSTRACT

A web (W) is passed from a preceding treatment stage to a finishing device in which the web (W) is finished in the finishing device and from which finishing device the web (W) is passed further to a subsequent treatment stage. The web (W) is brought to a roll (11; 14) of the finishing device as supported substantially before a nip area (N1; N2). The web (W) is passed from the circumference of a roll (12; 15) of the finishing device as substantially supported afler the nip area (N1; N2). A device for passing a web in connection with a finishing device of a paper machine causes a web (W) to be brought by the device to the circumference of a roll (11; 14) of the finishing device substantially before a nip area (N1; N2) and/or the web (W) can be passed from the circumference of a roll (12; 15) of the finishing device substantially after the nip area (N1; N2).

13 Claims, 1 Drawing Sheet

FOREIGN PATENT DOCUMENTS

| | | | |
|---|---|---|---|
| FI | 973725 | | 9/1997 |
| FI | 102485 | B | 12/1998 |
| GB | 1 540 056 | | 2/1979 |
| WO | WO 98/45534 | A1 | 10/1998 |
| WO | WO 99/14427 | * | 3/1999 |
| WO | WO 99/14427 | A1 | 3/1999 |
| WO | WO 99/64671 | * | 12/1999 |
| WO | WO 02/42553 | A1 | 5/2002 |

OTHER PUBLICATIONS

International Search Report issued in International Patent Application No. PCT/FI01/01008.
International Preliminary Examination Report issued in International Patent Application No. PCT/FI01/01008.

* cited by examiner

METHOD AND DEVICE FOR PASSING A WEB IN CONNECTION WITH A FINISHING DEVICE OF A PAPER OR BOARD MACHINE

CROSS REFERENCES TO RELATED APPLICATIONS

This application is a U.S. national stage application of International Application No. PCT/FI01/01008, filed Nov. 21, 2001, and claims priority on Finnish Application No. 20002550, filed Nov. 21, 2000, the disclosure of each application being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

As known in the state of the art, free draws have been used in paper machines when passing a paper web from one treatment stage to the next. The general trend today is that attempts are being made to pass the paper web as supported from one treatment stage to the next, and the development has indeed moved forward so that the wet end and the dryer section of the paper machine have for the most part been provided with means so that the transfer of paper is supported over the entire distance. However, in finishing there are stages in which unsupported runs of the web are still used at present, for example, in connection with calenders or on-line coating devices. Since the current trend is also that finishing devices are connected as on-line units to the paper machine, the significance of web support matters for the efficiency of the total line is greater than before when using off-line further treatment units. Since all unit process devices are in the same chain, the problems presented by free draws in the transfer of the web and possible web breaks cause problems to the entire line and may cause even a shutdown of the entire line.

Today's paper machines also aim at an increase of speed and decrease of the basis weight of the paper web as well as at higher efficiency requirements. Thus, unsupported runs cause problems, and therefore their elimination is very important.

Thus, it is an object of the invention to provide a method and a device in connection with which the run of the web is supported in connection with a finishing device.

With respect to the state of the art associated with the invention, reference is made to FI patent application 973725 which discloses an arrangement in which a web is conveyed by means of a support wire or equivalent to a multi-nip calender from the last drying cylinders placed substantially higher than the other cylinders of a dryer section, on which support wire the web is passed to the first pre-nip of the calender formed between the topmost calender roll and a belt calender roll or a wire guide roll.

An arrangement is known from the state of the art in which a paper web is passed as a supported run through a calender supported by a support member which has been guided to run through a calendering nip of the calender. In this respect, reference is made to FI patent 95 061. A problem in this prior-art arrangement is that the support member of paper influences the process itself and thus also the quality of the paper being manufactured as the support member runs through the nip. Further, this restricts the selection of the support member material to be used because the support member thus takes part in the process, which means that the material of the support member shall be selected according to the demands of the process and the process parameters shall be adjusted taking account of the effect of the support member.

SUMMARY OF THE INVENTION

It is thus a particular object of the invention to provide a fully supported run of the paper web in connection with a finishing device, which does not affect the manufacturing process itself, nor the quality of the paper that is manufactured.

In accordance with the invention, a web, in particular a paper or board web, is brought to the circumference of a roll in a finishing device as supported substantially before the nip area and the paper web leaves the circumference of the roll of the finishing device and is passed to be supported by means of a support member substantially after the nip area. In accordance with the invention, the paper web is brought to the finishing device while supported by a support member, for example, a belt, a felt or a wire or equivalent such that the transfer is supported over the entire distance from a preceding treatment stage to said finishing stage, during it and after it further to the following treatment stage after it.

In accordance with the invention, a support member loop is used in connection with which two or more rolls have been arranged to guide it, and onto which support member a paper web is passed and on support of which support member the paper web is conveyed into connection with a roll of a finishing device substantially before the nip of the finishing device and, in a corresponding manner, the web is passed by means of a support member loop from a roll of the finishing device to further treatment. The support member runs past the roll substantially tangentially to the roll of the finishing device.

The invention is particularly suitable for use in connection with calenders, in particular soft calenders, in which connection it also provides the advantage that, when the support member is placed such that the paper web to be calendered is guided to run on the circumference of a thermo roll before a nip, the paper web and also the support member for its part form a shield which prevents the heat of the thermo roll from evaporating into the surroundings, with the result that the heat of the thermo roll is transmitted to the paper. By this means, the web can be passed to the nip while it is hot and the heat of the thermo roll can be utilised with a greater efficiency than in the arrangements known from the state of the art.

The apparatus in accordance with the invention has been placed in connection with a finishing device and the process stage preceding it is constituted by, for example, a dryer section or a coating unit and it is followed by, for example, a reeling or coating unit and, in accordance with the invention, the web runs from the preceding process stage to the subsequent process stage through the process stage in question as supported all the time by means of support members and the rolls used in the process stages.

The support member according to the invention is formed of a loop-shaped support member which is guided by two or more rolls, and one or more support member units have been arranged in connection with a finishing device to support the web.

When, in accordance with the invention, the run of the web has been provided as supported in connection with a finishing device, it is possible to raise the speed of the paper machine and use paper grades having a lower basis weight. Thereby, a greater efficiency is achieved on the paper machine. A supported run is not so susceptible to web breaks and other disturbances, whereby substantial benefits are achieved in the entire on-line process.

BRIEF DESCRIPTION OF THE DRAWINGS

In the following, the invention will be described in more detail with reference to the figures of the accompanying drawing, to the details of which the invention is, however, not by any means meant to be narrowly confined.

DESCRIPTION OF THE PREFERRED EMBODIMENTS

Figure 1:
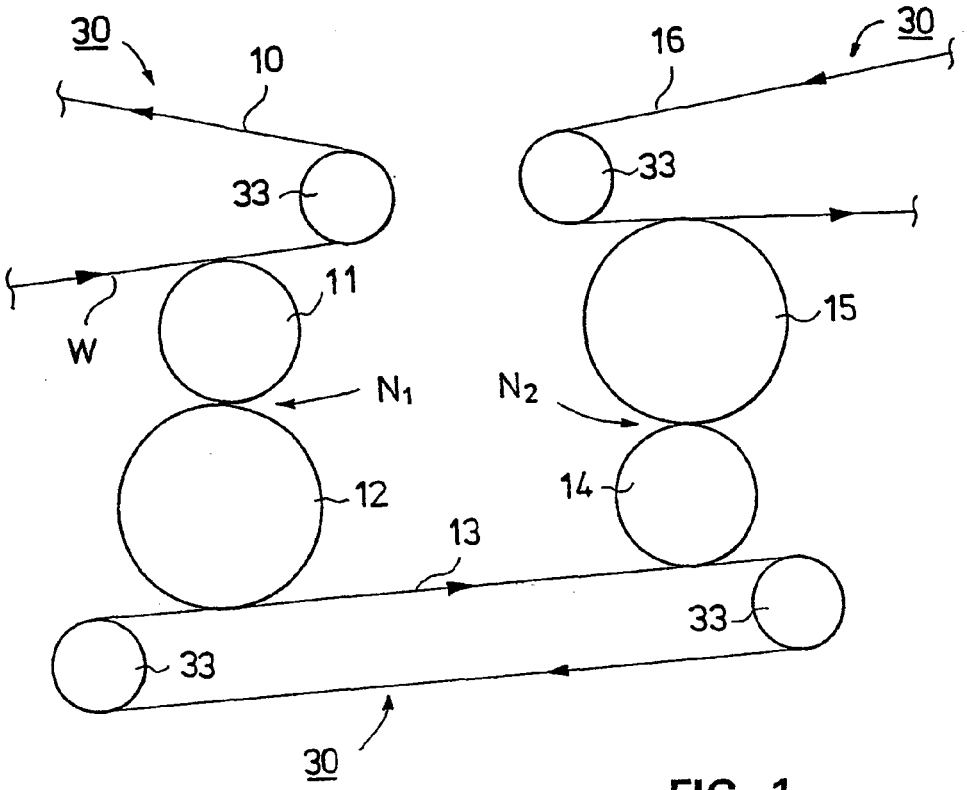
FIG. 1 is a schematic view of one application of the invention in connection with a two-nip soft calender.

As shown in FIG. 1, a paper web W is brought by a support member 10 to a Sym-roll 11 of a soft calender, from which it is passed along the roll 11 into a calendering nip N1 and further from the surface of a thermo roll 12 by means of a support member 13 to a Sym-roll 14 of a subsequent calendering nip N2 and further to a thermo roll 15, from which it is passed by means of a support member 16 to further treatment, for example, to a reel-up. Thus, a loop-shaped support member 13 has also been disposed in connection with the run between the calendering nips N1, N2, on which support member the web W is passed as supported from, for example, a thermo roll of the calendering nip N1 to, for example, a Sym-roll of the following nip N2.

Figure 2:
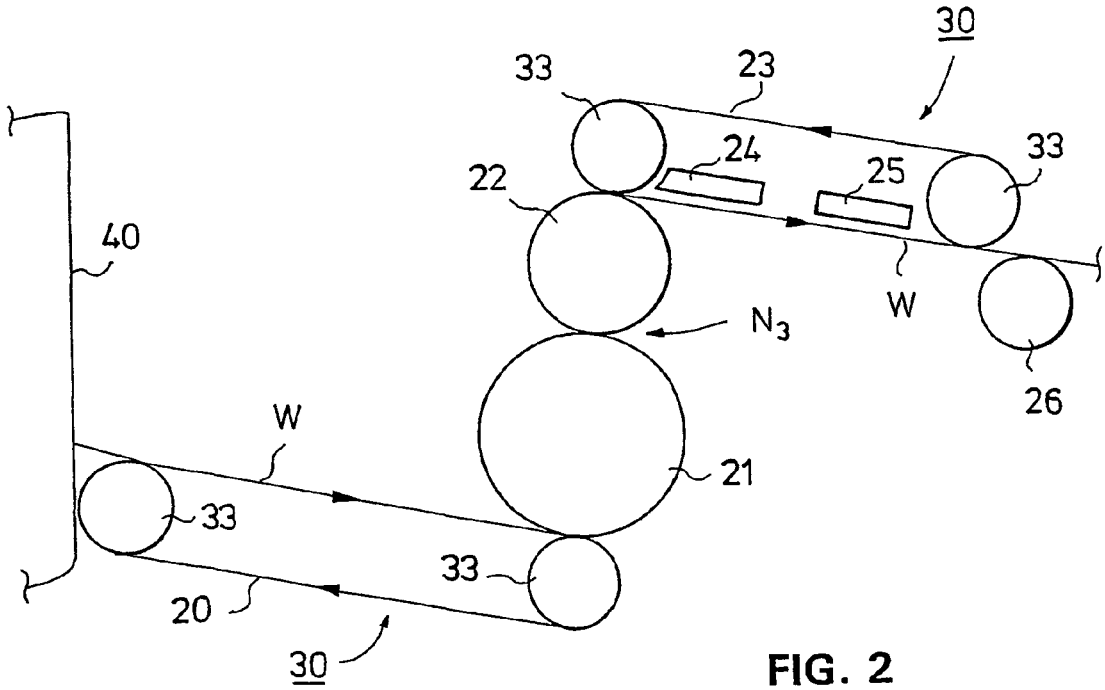
FIG. 2 is a schematic view of one application of the invention in connection with a one-nip soft calender.

As shown in FIG. 2, a paper web W is passed from a dryer section 40 of a paper machine to a support belt 20, by means of which said web W is transported to a thermo roll 21 of a calender and passed along its surface to a calendering nip N3 and further along the surface of a Sym-roll 22 to a second support belt 23, which has been placed above the paper web W and in connection with which, for example, blow suction boxes 24, 25 have been arranged to support the run of the web W. After that, the web W is passed by means of a roll 26 to further treatment.

As shown in FIGS. 1 and 2, a support member unit 30 comprises a support member 10, 13, 16, 20, 23, for example, a belt, a wire, a felt or equivalent, which has been arranged to run in a loop-like fashion while guided by guide rolls 33. Depending on the application, two or more guide/alignment rolls 33 have been arranged in connection with each support member 10, 13, 16, 20, 23.

As illustrated in FIGS. 1 and 2, the paper web W is passed to the calender substantially before the calendering nip N1; N2; N3 by means of the support member 10; 13; 20 and the web W is passed away from a roll of the calender substantially after the nip N1; N2; N3 and passed to further treatment by means of the support member 13; 16; 23. It shall be particularly noted that the support member does not take part in the process because it does not run through the calendering nip N1, N2, N3, but, instead, the support member brings the web W substantially close to the nip to the circumference of the roll defining the nip and, in a corresponding manner, the support member receives the web substantially after the nip from the circumference of the roll defining the nip.

Above, the invention has been described with reference to only some of its advantageous application examples, to the details of which the invention is by no means meant to be narrowly confined.

The invention claimed is:

1. A method for passing a web in connection with a calender of a paper or board machine, comprising the steps of:

passing the web from a preceding process stage on a first support member loop which carries the web from the preceding process stage to a first roll of the calender, the first roll having a circumference and forming a first nip with a second roll;

supporting the web on the first support member loop prior to being passed to the first roll and passing the web to the first roll circumference substantially before the first nip such that the first support member loop does not pass through the first nip;

passing the web from the circumference of the first roll to the first nip defined between the first roll and the second roll of the calender; and calendering the web at the first nip, and passing the web along a circumference of the second roll between the first nip and a second support member loop from which the web is transferred to a subsequent process stage;

wherein one of the first roll and the second roll is a thermo roll and the web is wrapped about a portion of the thermo roll to form a shield so preventing loss of heat from said thermo roll; and wherein the web runs from the preceding process stage to the subsequent process stage through the calender while being supported all the time by the first support member loop, the first calender roll, the second calender roll and the second support member loop.

2. The method of claim 1 wherein one of the first roll and the second roll is a soft roll so that the web is calendered in a soft calender.

3. The method of claim 1, further comprising the steps of passing the web from the second support member loop to a second calender having a third roll, and from the third roll to a fourth roll of the second calender which defines a second nip with the third roll, and from the fourth roll to a third support member loop, wherein no support member loop passes through a calender nip.

4. The method of claim 1, wherein the first support member loop has a run which is guided by two or more rolls.

5. The method of claim 1, wherein the first support member loop runs past the first roll tangentially to the first roll.

6. A calender apparatus in a paper or board machine, the apparatus comprising:

a first support member which carries a web from a preceding treatment stage;

a first roll which receives the web from the first support member; the first roll having a circumference and forming a first nip with a second roll, wherein the web is supported on the first roll circumference substantially before the nip, and travels through the first calendering nip, and wherein the first support member does not pass through the first calendering nip;

a second support member which receives the web from the second roll after the first calendering nip;

a third roll which receives the web from the second support member;

a fourth roll which forms a second calendering nip with the third roll, wherein the second support member does not extend through the second calendering nip.

7. The apparatus of claim 6 wherein the calender is a soft calender and one of the first roll and the second roll is a thermo roll.

8. The apparatus of claim 6 wherein the second support member comprises a support member loop having at least two rolls disposed within the loop which guide the support member loop.

9. The apparatus of claim 6 wherein the second support member has portions which run tangentially to the second roll.

10. The apparatus of claim 6 further comprising a third support member which receives the web after the fourth roll and passes the web to a subsequent treatment stage.

11. A calender apparatus in a paper or board machine, the apparatus comprising:

a support member loop formed from a belt, wire, or felt;

a first calender roll, having a circumference;

a second calender roll having a circumference and forming a calender nip with the first calender roll;

a paper or board web extending along the support member, and on to the circumference of the first calender roll, and wherein the support member loop is spaced from the calender nip, the web extending along the first calender roll circumference and passing through the nip and extending along a circumference of the second calender roll; and a second support member loop formed from a belt, wire, or felt, the web extending from the second calender roll to the second support member loop, wherein the first calender roll and the second calender roll form a soft calender with one thermo roll.

12. The apparatus of claim 10 further comprising;

a third calender roll and a fourth calender roll forming a second nip and a second soft calender having one heated thermo roll; and wherein the third calender roll is tangent to the second support member loop, and the web extends along the second support member loop, the third calender roll, and through the second nip and along the fourth calender roll to a third support member loop formed from a belt, wire, or felt,which is tangent to the fourth roll.

13. The apparatus of claim 11 wherein the support member loop is tangent to the first calender roll;

wherein the second support member loop is tangent to the second calendar roll.

* * * * *

UNITED STATES PATENT AND TRADEMARK OFFICE

CERTIFICATE OF CORRECTION

PATENT NO. : 7,179,349 B2
APPLICATION NO. : 10/432202
DATED : February 20, 2007
INVENTOR(S) : Pekka Koivukunnas It is certified that error appears in the above-identified patent and that said Letters Patent is hereby corrected as shown below:

In column 6, line 9 of the issued patent, “10” should be --11--.

Signed and Sealed this

Twenty-fourth Day of April, 2007

JON W. DUDAS
*Director of the United States Patent and Trademark Office*